United States Patent [19]

Martin et al.

[11] Patent Number: 5,052,364

[45] Date of Patent: Oct. 1, 1991

[54] ADJUSTABLE ARROW REST

[75] Inventors: Terry G. Martin; George T. Newbold, both of Walla Walla, Wash.

[73] Assignee: Martin Archery, Inc., Walla Walla, Wash.

[21] Appl. No.: 568,350

[22] Filed: Aug. 15, 1990

[51] Int. Cl.[5] ..... F41B 5/00

[52] U.S. Cl. ..... 124/44.5

[58] Field of Search ..... 124/23.1, 24.1, 25.6, 124/44.5, 88

[56] References Cited

U.S. PATENT DOCUMENTS

| | | | |
|---|---|---|---|
| 3,108,584 | 10/1963 | Coe . | |
| 3,669,059 | 6/1972 | Stuart . | |
| 3,871,352 | 3/1975 | Stanislawski et al. . | |
| 4,398,528 | 8/1983 | Troncoso | 124/44.5 X |
| 4,664,093 | 5/1987 | Nunemaker | 124/24.1 |
| 4,899,716 | 2/1990 | Martin et al. . | |

*Primary Examiner*—Peter M. Cuomo

*Assistant Examiner*—John A. Ricci

*Attorney, Agent, or Firm*—Wells, St. John & Roberts

[57] ABSTRACT

An adjustable arrow rest apparatus for mounting to a handle of an archery bow comprises, a) a base which is mountable to an archery bow handle; b) a support bar extending from the base; c) a first arrow launcher movably mounted to the support bar for lateral movement therealong; and d) a second arrow launcher movably mounted to the support bar for lateral movement therealong independent of the first arrow launcher. The second arrow launcher comprises: a) a substantially upright support so movably mounted to the support bar; b) a side pressure absorbing unit to absorb side pressure exerted by an arrow in the direction of the bow handle, the side pressure absorbing unit being movably mounted to the upright support for selective elevational movement relative thereto; and c) a set screw or other components for releasably setting the side pressure absorbing unit at a selected elevational position relative to the upright support.

14 Claims, 1 Drawing Sheet

ADJUSTABLE ARROW REST

TECHNICAL FIELD

This invention relates generally to arrow rests for archery bows.

BACKGROUND OF THE INVENTION

There are many arrow rests available today for an archer's needs, such as is indicated on pages 16 through 20 of the Martin Archery 1990 Catalog.

Arrow rests are typically attached to an archery bow for supporting an arrow before and during release. It is desirable for an archer to be able to adjust their arrow rest to align it with a drawn bowstring, and to adapt it to the shooting and aiming styles of the archer. It is most desirable to have the ability to adjust an arrow rest both vertically and horizontally with respect to the bow, for precision in aiming.

Another consideration in the design of an arrow rest is the absorption of the pressure exerted by the arrow in a sideward direction as the arrow is released. Initially upon release of the bow string, a tremendous driving force is applied to the rear end of the arrow. In theory, if the force is perfectly aligned with the axis of the arrow, with no induced horizontal or vertical forces, the arrow will maintain a nonbending, straight shaft during its initial flight. As a practical matter, it is impossible even for the most skilled archers to apply all of the bow force along the axis of the arrow. Invariably, both horizontal and vertical off-axis forces are applied which cause the arrow to bend or flex.

The degree of these off-axis forces depends in part upon how the bow string is released. It has been known for many years that when a person holds and releases the bow string with their fingers ("finger release"), the bow string rolls or slides of the fingers. This imparts a major lateral or horizontal force and a minor vertical force to the arrow, and causes the arrow to bend or bow in a horizontal plane during its initial flight. As such, the arrow initially goes through a series of alternating left and right bowing or flexing motions. This alternating horizontal bowing is commonly referred to as "archer's paradox." The action of the fletching ultimately stabilizes the arrow flight and eliminates the bending oscillations of the shaft. The "archer's paradox" phenomenon has a material impact on arrow flight, arrow speed, shot repeatability and correspondingly the accuracy of the shot.

To reduce the effects of "archer's paradox," various well known devices are utilized at the bow sidewall to engage the arrow shaft and provide lateral dampening of the horizontal arrow oscillations. Such devices are commonly referred to as pressure buttons or "burger" buttons. These are devices which thread into the hole of a bow handle, and project laterally into the bow window for engaging the side of an arrow shaft. Such are shown by way of example on pages 16–20 of the Martin Archery 1990 catalog. The position of the side pressure buttons is determined by the position of the hole on the bow handle.

The vertical component of an off-axis force imparted to the end of an arrow upon bow string release induces vertical oscillations in the initial flight of an arrow. These vertical oscillations are sometimes referred to as "porpoising". Mechanical releases are known to reduce "archer's paradox", increase arrow speed, and thus increase shot accuracy. However, mechanical releases are also known to tend to increase arrow porpoising as compared to finger release. To accommodate such porpoising, launcher-type arrow rests have been developed, such as is shown and described in our U.S. Pat. No. 4,899,716, which is hereby incorporated by reference.

It would be desirable to provide an arrow rest having greater adjustability and one which is adaptable to be used by both finger and mechanical release shooters.

BRIEF DESCRIPTION OF THE DRAWINGS

The preferred embodiment of the invention is illustrated in the accompanying drawings, in which.

DETAILED DESCRIPTION OF THE PREFERRED EMBODIMENTS

Figure 1:
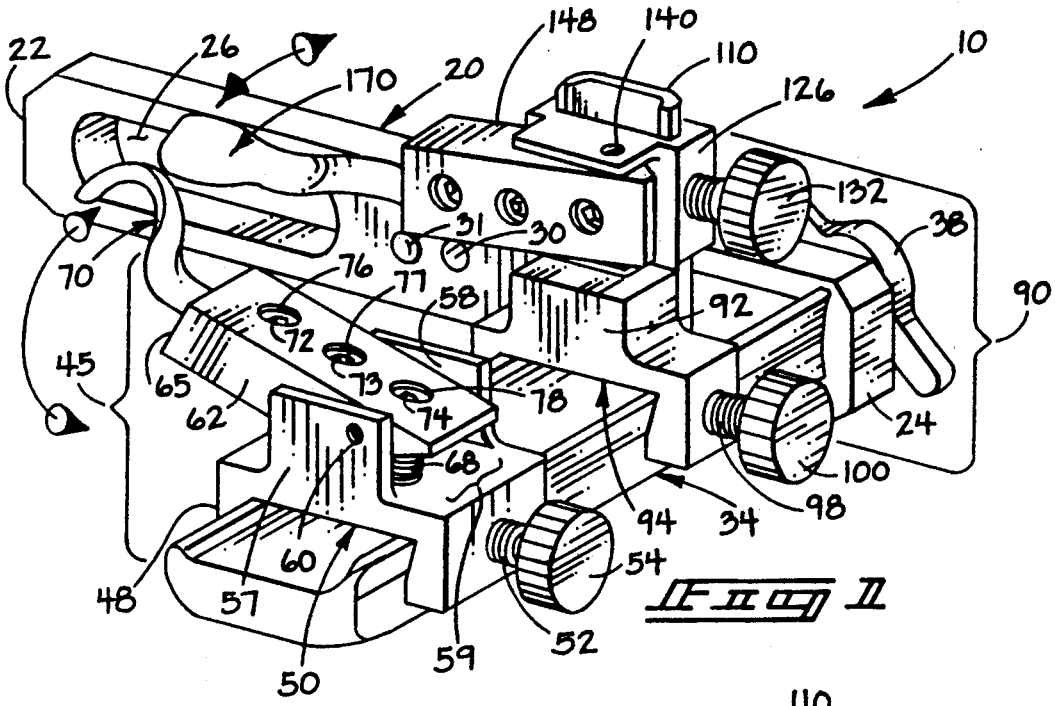
FIG. 1 is a left rear, downward perspective view of an adjustable arrow rest in accordance with the invention.
Figure 2:
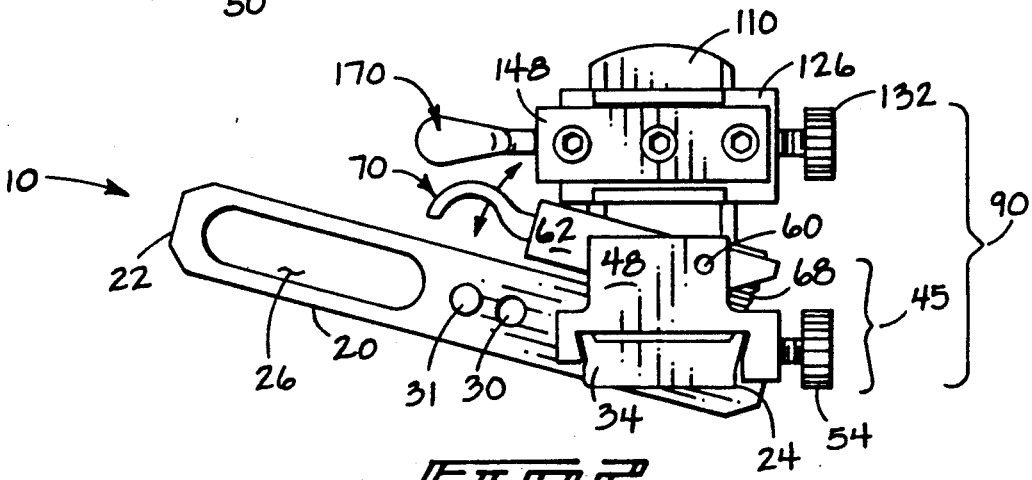
FIG. 2 is a left side elevational view of the arrow rest of FIG. 1.

The following disclosure of the invention is submitted in furtherance with the constitutional purpose of the Patent Laws "to promote the progress of science and useful arts" (Article 1, Section 8).

This invention comprises an adjustable arrow rest for mounting to a handle of an archery bow. In one aspect, the arrow rest comprises a substantially upright support; mounting means for securing the upright support to an archery bow; and a side pressure absorbing unit to absorb side pressure exerted by an arrow in the direction of the bow handle. This side pressure absorbing unit is movably mounted to the upright support for selective elevational movement therealong. Locking means are provided for releasably setting the side pressure absorbing unit to a selected elevational position along the upright support.

In another aspect, an adjustable arrow rest apparatus in accordance with the invention comprises a base which is mountable to an archery bow handle, and a support bar extending from the base. A first arrow launcher is movably mounted to the support bar for lateral movement therealong. A second arrow launcher is also movably mounted to the support bar for lateral movement therealong independent of the first arrow launcher. The second arrow launcher comprises a substantially upright support movably mounted to the support bar, and a side pressure absorbing unit to absorb side pressure exerted by an arrow in the direction of the bow handle. This side pressure absorbing unit is movably mounted to the upright support for selective elevational movement relative thereto. The second arrow launcher further comprises locking means for releasably setting the side pressure absorbing unit at a selected elevational position relative to the upright support.

Referring to the figures, a preferred embodiment of an adjustable arrow rest apparatus in accordance with the invention, for mounting to an archery bow, is indicated generally by reference numeral 10. Arrow rest apparatus 10 includes an elongated base 20 which would be mounted to a bow handle (not shown)l. Base 20 includes a fore end 22 and an aft end 24. A longitudinally elongated shot 26 is formed transversely through base 20 adjacent fore end 22. A bolt (not shown) can be extended through elongated slot 26 for rigidly securing base 20 relative to an archery bow handle. The elongated nature of slot 26 enables various positional adjustments of base 20 relative to the bow. A pair of threaded holes 30 and 31 extends through base 20 at its middle section adjacent slot 26. A locking screw 32 is receivable by at least one of these holes. Screw 32 bears against the bow to provide an additional securing effect of base 20 to the bow, if desired. Alternate bases for mounting to an archery bow handle, such as shown by way of example in our U.S. Pat. No. 4,889,102, could of course be used without departing from the principles and scope of the invention.

An elongated support bar 34 extends generally perpendicularly from adjacent aft end 24 of base 20. Support bar 34 is pivotal or rotational relative to base 20 by means of a locking bolt 38 which extends through a hole (not visible) in base 20 and threads into a hole (not visible) in the inner end of support bar 34. Bolt 38 serves as a pivoting mount for support bar 34 and as a locking means for securing support bar 34 relative to base 20. Bolt 38 has an appropriately configured plastic t-cap or winged cap as shown. The winged cap enables an archer to quickly and easily adjust the angular positioning of support bar 34 relative to base 20.

Support bar 34 is of a male dovetail shape in lateral cross-section along its length. A lock washer and a plastic washer are received by bolt 38 and positioned between the plastic cap of bolt 38 and the base 20 to better enable selective locking of base 20 with respect to support bar 34. A second lock washer is received by bolt 38 and positioned between the base 20 and the support bar 34, also enabling better selective locking of base 20 with respect to support bar 34. Such a construction is more fully shown and described in our U.S. Pat. No. 4,899,716.

A first arrow launcher 45 and a second arrow launcher 90 are movably mounted to support bar 34. Each is mounted relative to support bar 34 for lateral movement therealong independent of the other.

First arrow launcher 45 has a mounting block or carriage 48 slidably mounted to support bar 34. The bottom of mounting block 48 includes a dovetail slot or opening 50 corresponding in size and shape to receive the male dovetail cross-sectional configuration of support bar 34. This dovetail arrangement enables sliding movement of mounting block 48 along support bar 34, but precludes any rotation of mounting block 48 relative to support bar 34. In the depicted embodiment, mounting block 48 is removable from support bar 34 by sliding it completely off the left end of support bar 34.

The aft end of mounting block 48 includes a threaded opening 52 and a locking set screw 54 which has an enlarged cap. Set screw 54 engages against support bow 34 at selected positions along the length thereof. Set screw 54 functions as a releasable locking means for enabling the position of mounting block 48 to be selectively varied.

Mounting block 48 includes a pair of upwardly projecting side walls 57 and 58, which define a channel 59 therebetween. A pivot pin 60 is connected to and extends between side walls 57 and 58 through channel 59.

Figure 3:
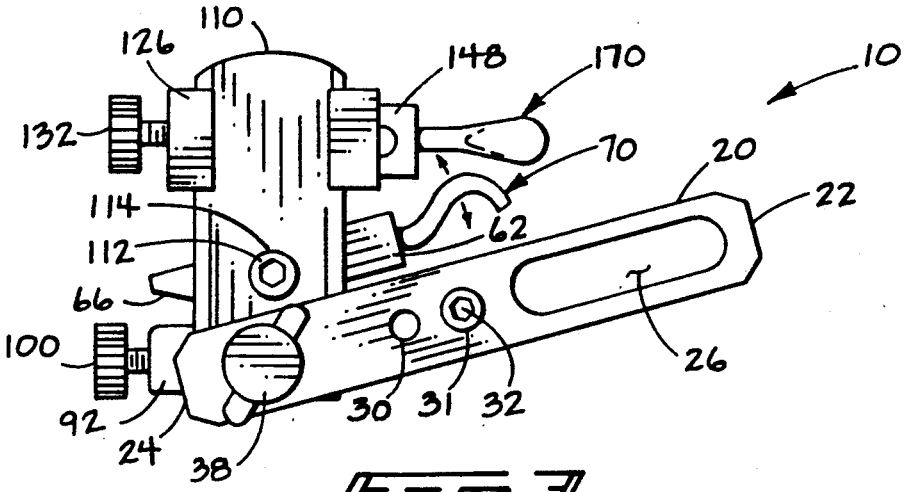
FIG. 3 is right side elevational view of the arrow rest of FIG. 1.

First arrow launcher 45 further comprises an elongated launcher block 62 having a generally square cross-section, which is positioned within mounting block channel 59. Launcher block 62 includes a lateral hole (not visible) through which pivot pin 60 is received. Launcher block 62 has fore end surface 65 (FIG. 1), which is generally square with its elongated upper and lower surfaces. It has aft end surface 66 (FIG. 3) which is angled relative to the upper and lower elongated surfaces. Launcher block 62 also has three threaded holes 72, 73 and 74 extending therethrough between its upper and lower elongated surfaces. Hole 72 is adjacent fore end surface 65. Hole 73 is approximately midway along the length of block 62, and is configured like opening 94 in the arrow rest of our U.S. Pat. No. 4,899,716. Hole 74 is adjacent the aft end of launcher 62. Pivot pin 60 is received through block 62 between holes 73 and 74. Screws 76 and 77 are received by threaded holes 72 and 73, respectively. A stop set screw 78 is received by threaded hole 74.

Fore end surface 65 has a longitudinal opening (not visible) which receives an arm 70. Arm 70 is held and positionable within the longitudinal opening by fore screw 76. Arm 70 has a curving, thumb-shaped surface for engaging the shaft of an arrow.

A spring is received between launcher 62 and block 48 in the same manner as shown and described in our U.S. Pat. No. 4,899,716 (columns 3-5, FIGS. 5-7). Screw 77 enables the tension of the spring to be adjusted. Set screw 78 enables adjustment of the elevation of arm 70 by engaging block 48.

Second arrow launcher 90 has a carriage block 92 slidably mounted to support bar 34. The bottom of carriage block 92 includes a complementary dovetail slot or opening 94 to receive the male dovetail cross-sectional configuration of support bar 34. Carriage block 92 would be removable from support bar 34 by sliding it completely off the left side of support bar 34 behind first arrow launcher 45.

The aft end of carriage block 92 includes a threaded opening 98 and a locking set screw 100 which has an enlarged cap. Set screw 100 functions as a releasable locking means for enabling the position of carriage block 92 to be selectively varied.

Connected to block 92 is a substantially upright support 110. A counter sunk bore 114 is provided in the lower portion of support 110 and receives a mounting bolt 112. Bolt 112 is an Allen socket screw which slides through bore 114 such that its head is flush with the outer surface of support 110. Bolt 112 is threadably received within an opening (not visible in the drawings) in carriage block 92 to rigidly secure upright support 110 thereto. Support 110 is perpendicularly mounted to support bar 34, and has a male dovetail cross-sectional configuration along its length.

A mounting block 126, launcher block 148 and thumb-like arm 170 are received relative to upright support 110. Mounting block 126, launcher block 148 and arm 170 are identical in construction to mounting block 48, launcher block 62, and arm 70 of first arrow launcher 45. Launcher block 148 and arm 170 are pivotally supported by a pin 140 for pivoting about an upright pivot axis. Mounting block 126, launcher block 148 and arm 170 define a side pressure absorbing unit to absorb side pressure exerted by an arrow in the direction of the bow handle. Block 126 is elevationally movable relative to support 110, and its position relative thereto can be releasably locked by the illustrated set screw 132.

The adjustable arrow rest can be manufactured from materials and by techniques well-known in the art.

The above described arrow rest allows for optimum adjustability by the archer. First arrow launcher 45 may be adjusted laterally along support bar 34 by means of set screw 54, thereby altering the distance with respect to the bow handle. Arm 70 and launcher block 62 can be adjusted elevationally by the threading of stop set screw 78. The angular orientation of arm 70 can be adjusted or set with screw 76.

Second arrow launcher 90 is likewise adjustable laterally along support bar 34 by means of set screw 100. The position of launcher block 148 and arm 170 can be elevationally adjusted by second mounting block 126 along upright support 110, and locking it at a desired elevation with set screw 132. Arm 170 and launcher block 148 can be further "fine-tuned" laterally by threading of the aft stop set screw in block 148. The angular orientation of arm 170 can likewise be adjusted with the fore adjustment screw in block 148.

In compliance with the statute, the invention has been described in language more or less specific as to structural features. It is to be understood, however, that the invention is not limited to the specific features shown and described, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

We claim:

1. An adjustable arrow rest apparatus for mounting to a handle of an archery bow comprising:

a generally laterally extending support bar;

a substantially upright support movably mounted to said support bar;

mounting means for securing the support bar and the upright support to an archery bow handle;

a side pressure absorbing unit to absorb side pressure exerted by an arrow in the direction of the bow handle, the side pressure absorbing unit being slidably mounted to the upright support for selective sliding elevational movement therealong; and locking means for releasably setting the side pressure absorbing unit at a selected elevational position relative to the upright support.

2. An arrow rest according to claim 1 wherein the side pressure absorbing unit comprises:

a mounting block slidably mounted to the upright support for sliding elevational movement therealong; and a pivot arm pivotably supported by the mounting block for pivoting about an upright pivot axis.

3. An arrow rest according to claim 1 wherein the substantially upright support has a male dovetail cross-section, and the mounting block slidably mounted to the upright support for sliding elevational movement has a complementary female dovetail slot to receive the upright support cross-section.

4. An arrow rest according to claim 1 wherein the substantially upright support has a male dovetail cross-section.

5. An adjustable arrow rest apparatus for mounting to a handle of an archery bow comprising:

a base which is mountable to an archery bow handle;

a support bar extending from the base;

a first arrow launcher movably mounted to the support bar for lateral movement therealong; and a second arrow launcher movably mounted to the support bar for lateral movement therealong independent of the first arrow launcher, the second arrow launcher comprising:

a substantially upright support so movably mounted to the support bar;

a side pressure absorbing unit to absorb side pressure exerted by an arrow in the direction of the bow handle, the side pressure absorbing unit being movably mounted by the upright support for selective elevational movement relative thereto; and locking means for releasably setting the side pressure absorbing unit at a selected elevational position relative to the upright support.

6. An arrow rest according to claim 5 wherein the side pressure absorbing unit comprises:

a mounting block movably mounted to the upright support; and a pivot arm pivotally supported by the mounting block for pivoting about an upright pivot axis.

7. An arrow rest according to claim 5 wherein the substantially upright support has a male dovetail cross-section, and the mounting block has a complementary female dovetail slot.

8. An arrow rest according to claim 5 wherein the substantially upright support has a male dovetail cross-section.

9. An arrow rest according to claim 5 wherein the side pressure absorbing unit is slidably mounted to the upright support.

10. An arrow rest according to claim 5 wherein the support bar has a male dovetail cross-section, and further comprising:

a second arrow launcher support block having a dovetail slot complementary in size and shape to receive the male dovetail cross-section of the support bar;

the second arrow launcher support block having a threaded opening; and a bolt received through the upright support and within the threaded opening to mount the upright support to the second arrow launcher support block.

11. An arrow rest according to claim 10 wherein the side pressure absorbing unit comprises:

a mounting block movably mounted to the upright support; and a pivot arm pivotably supported by the mounting block for pivoting about an upright pivot axis.

12. An arrow rest according to claim 10 wherein the upright support has a male dovetail cross-section, and the mounting block has a complementary female dovetail slot to receive the upright support cross-section.

13. An arrow rest according to claim 10 wherein the side pressure absorbing unit is slidably mounted to the upright support.

14. An adjustable arrow rest apparatus for mounting to a handle of an archery bow comprising:

a base which is mountable to an archery bow handle;

a support bar extending from the base, the support bar having a male dovetail cross-section;

a first arrow launcher slidably mounted to the support bar for lateral movement therealong, the first arrow launcher comprising:

a first mounting block slidably mounted to the support bar, the mounting block having a female dovetail slot which is complementary in size and shape to receive the upright support cross-section; and a first pivot arm pivotably supported by the mounting block for pivoting about a lateral pivot axis;

a second arrow launcher slidably mounted to the support bar for lateral movement therealong independent of the first arrow launcher, the second arrow launcher comprising:

a substantially upright support movably mounted to the support bar, the upright support having a male dovetail cross-section;

a side pressure absorbing unit to absorb side pressure exerted by an arrow in the direction of the bow handle, the side pressure absorbing unit being slidably mounted by the upright support for selective elevational movement relative thereto, the side pressure absorbing unit comprising:

a second mounting block slidably mounted to the upright support, the mounting block having a female dovetail slot which is complementary in size and shape to receive the upright support cross section; and a second pivot arm pivotably supported by the mounting block for pivoting about an upright pivot axis;

the second arrow launcher further comprising locking means for releasably setting the side pressure absorbing unit at a selected elevational position relative to the upright support.

* * * * *